US008025617B2

(12) United States Patent
Tennant et al.

(10) Patent No.: US 8,025,617 B2
(45) Date of Patent: Sep. 27, 2011

(54) STRETCHING APPARATUS

(76) Inventors: Robert E. Tennant, Portland, OR (US); William E. Dieter, Portland, OR (US)

( * ) Notice: Subject to any disclaimer, the term of this patent is extended or adjusted under 35 U.S.C. 154(b) by 1511 days.

(21) Appl. No.: 11/331,860

(22) Filed: Jan. 13, 2006

(65) Prior Publication Data

US 2006/0160673 A1 Jul. 20, 2006

Related U.S. Application Data

(60) Provisional application No. 60/644,210, filed on Jan. 14, 2005.

(51) Int. Cl.
*A63B 23/00* (2006.01)

(52) U.S. Cl. ..... 482/148

(58) Field of Classification Search ..... 482/148; 601/23, 149, 34; 602/27; 74/512
See application file for complete search history.

(56) References Cited

U.S. PATENT DOCUMENTS

| | | | | |
|---|---|---|---|---|
| 4,320,749 | A * | 3/1982 | Highley | 602/27 |
| 5,122,106 | A | 6/1992 | Atwood | |
| 5,338,276 | A | 8/1994 | Jull | |
| 5,345,630 | A * | 9/1994 | Healy | 5/708 |
| 5,354,260 | A | 10/1994 | Cook | |
| 5,416,939 | A * | 5/1995 | Maalouli | 5/610 |
| 5,460,596 | A * | 10/1995 | Brady | 601/35 |
| 5,507,711 | A | 4/1996 | Richardson | |
| 5,529,573 | A * | 6/1996 | Kelly et al. | 601/34 |
| 5,595,559 | A | 1/1997 | Viel | |
| 5,634,873 | A | 6/1997 | Carlstrom | |
| 5,855,538 | A | 1/1999 | Argabright | |
| 6,010,468 | A * | 1/2000 | Grove et al. | 601/23 |
| 6,068,580 | A | 5/2000 | Myers | |
| 6,338,700 | B1 | 1/2002 | Pollock | |
| 6,685,661 | B2 * | 2/2004 | Peled | 601/149 |
| 6,739,005 | B2 * | 5/2004 | Davis | 5/615 |

* cited by examiner

*Primary Examiner* — Loan Thanh
*Assistant Examiner* — Shila Jalalzadeh Abyane
(74) *Attorney, Agent, or Firm* — Hancock Hughey LLP

(57) ABSTRACT

The present invention concerns a stretching apparatus that is useful to apply controlled, gradual muscular stretching, and is particularly useful for controlled stretching of the hamstring muscle.

13 Claims, 3 Drawing Sheets

STRETCHING APPARATUS

This application claims the benefit of U.S. Provisional Application Ser. No. 60/644,210, filed Jan. 14, 2005.

TECHNICAL FIELD

This application relates to an apparatus for stretching a person's muscles, such as the hamstring muscles.

BACKGROUND

The terms "hamstring," "hamstrings" or "hamstring muscle" are generally used to refer to the three large muscles constituting the back of the upper leg. The hamstrings serve to flex the knee joint and extend the hip. Everyday activities as well as most athletic activities involve the repetitive contraction of the hamstring muscle. The hamstring muscle tightens as a result, and requires effective stretching to retain its full range of motion. In the absence of such stretching, the tight hamstrings will have a deleterious effect on the person's skeletal alignment, typically resulting in lower back and knee pain, as well as problems with posture.

Stretching any muscle is best done at a slow rate. Attempting to quickly stretch the muscle will rouse the muscle's inherent tendency to contract when pulled, thereby resisting the sought-after lengthening of the muscle.

SUMMARY OF THE INVENTION

The present invention concerns a stretching apparatus that is useful for controlled, gradual muscular stretching, and is particularly useful for controlled stretching of the hamstring muscle. In one embodiment, the stretching occurs while the stretched leg extends generally vertically upwardly adjacent to a stationary vertical surface. The stretched leg is supported for controlled, slow, forced rotation about the hip, away from that surface, thereby to stretch the hamstring muscle.

Preferably, the user of the apparatus is situated so that, apart from the stretched leg, the remainder of the person's muscle groups are relaxed, thereby allowing a focused effort for stretching the hamstring muscle.

Other advantages and features of the present invention will become clear upon study of the following portion of this specification and drawings.

DESCRIPTION OF PREFERRED EMBODIMENTS

Figure 1:
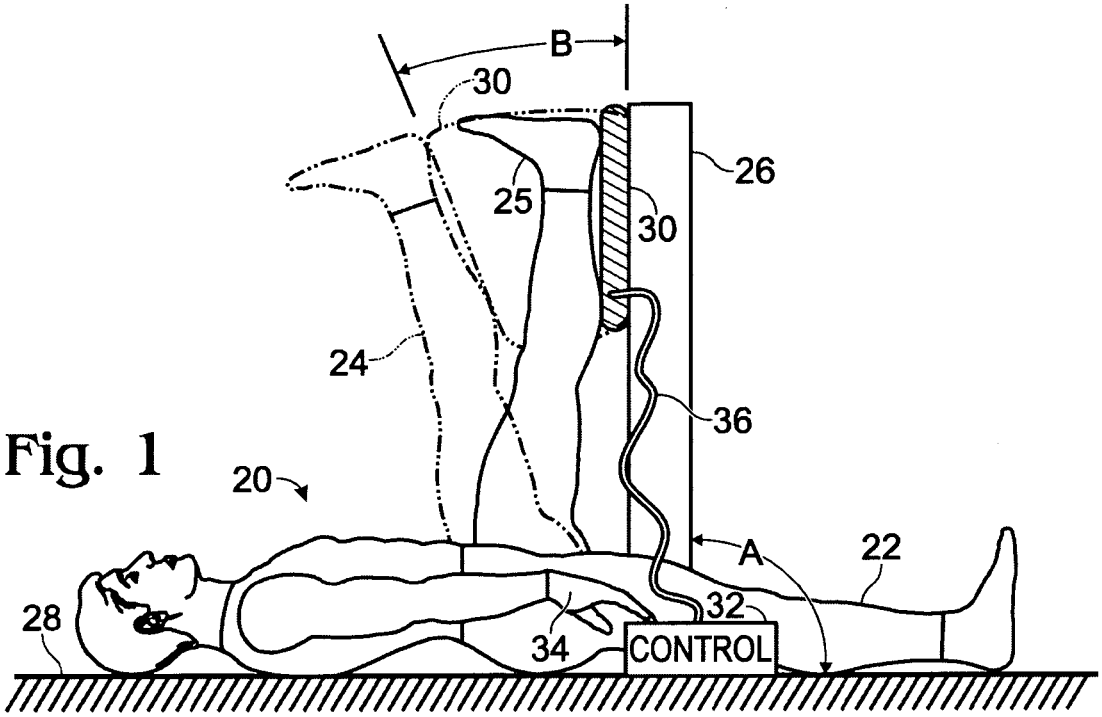
FIG. 1 is a diagram illustrating in a side view one embodiment of a stretching apparatus made in accordance with the present invention.

An apparatus made in accordance with the present invention is amenable for use in yoga exercises or physical therapy, with or without additional components for supporting or isolating the muscles to be stretched. FIG. 1 illustrates one preferred embodiment of a stretching apparatus that is employed by a user 20 for controlled, gradual stretching of the hamstring muscle. The apparatus may be operated while the user 20 is reclined, on his back, with one "rested" leg 22 extending horizontally on a flat surface 28. The other "stretched" leg 24 is rotated at the hip and extends vertically upwardly, with the knee held straight. The back of the stretched leg 24 is adjacent to the surface of a stationary, rigid member 26.

In one embodiment, the member 26 may be an existing doorjamb, which is the vertical component of a door frame. In such an embodiment, the components of the stretching apparatus include an expandable member 30 that will hereafter be referred to as an expander 30. The expander 30 is located adjacent to the vertical member 26 between that member and the back of the user's stretched leg 24. The expander 30 may abut or be removably attached to the stationary surface of the vertical member.

Figure 2:
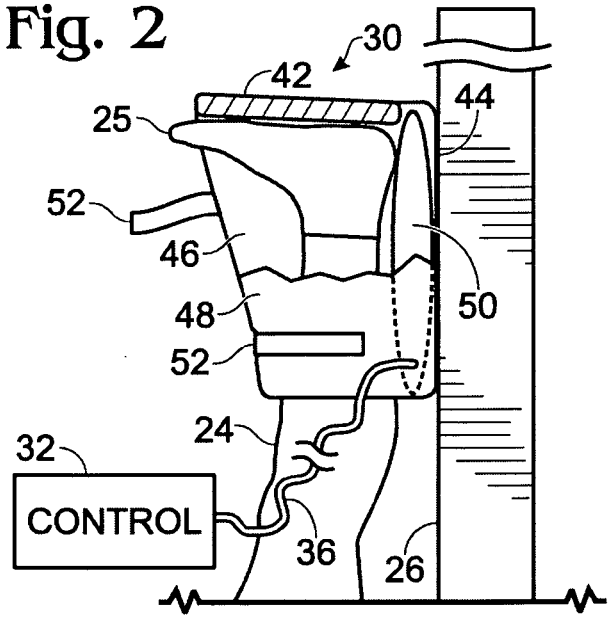
FIG. 2 is an enlarged view of an expandable part of the apparatus.

The expander 30 is cushioned and/or contoured to comfortably receive the stretched leg, preferably in the vicinity of the user's Achilles tendon. In this regard, the expander 30 may have a boot-like configuration as shown in FIG. 2 and discussed more below.

The expander 30 is controlled for providing incremental or gradual expansion from a contracted position to an expanded position for correspondingly gradual stretching of the user's hamstring muscle. As one aspect of this invention, the user may maintain the reclined position while remotely controlling the expander 30.

In the contracted position of the expander 30, the user's stretched leg 24 is generally vertical, thus making an angle "A" of about 90 degrees with the horizontal surface 28. The contracted position of the expander 30 appears in FIG. 1 as cross-hatching of the back portion of the expander 30 that is between the leg 24 and the vertical member 26. Movement of the expander 30 toward the expanded position (shown in dashed lines in FIG. 1) increases the angle between the stretched leg 24 and the surface 28 by angle "B" from vertical. The act of gradually moving the user's leg 24 through the angle "B" effectively stretches the hamstring muscle of that leg.

As noted, the expansion of the expander 30 is controlled by the user in a manner that permits the user to maintain an otherwise relaxed, reclined position. To this end, a remote control 32 is positionable near the hand 34 of the user. The expansion of the expander 30 may be provided by a pneumatic system, and the control 32 may comprise a hand pump or other valving that communicates with the expander 30 via line 36 for directing pressurized air into the expander 30 to expand it. The control 32 may also include a release valve for slowly returning the expander to the contracted state upon completion of the desired stretching time. A conventional sphygmomanometer bulb will suffice as the pump and release valve.

It is also contemplated that the control can be electronically automated with a simple controller for activating an air pump and associated valves for inflating and deflating the expander 30 in accord with built-in or user-defined programming.

FIG. 2 illustrates in greater detail a preferred embodiment of the expander 30. In this embodiment, the expander 30 has a boot-like configuration that includes a base 42, a back 44, and two opposing sidewalls 46, 48. The expander 30 may be formed of, for example, sewn synthetic material, such as nylon, that forms the outer casing for internal cushioning and an expandable air bladder 50. The base 42 of the expander 30 extends across the sole of the user's foot 25. The back 44 of the expander 30 extends from the rearward end of the base and along the back of the user's leg 24 generally adjacent to the Achilles tendon.

The sidewalls 46, 48 are attached to or integrally formed with the base 42 and back 44 and extend therefrom in a generally parallel relationship across the sides of the user's foot 25, ankle, and lower leg. Between the sidewalls 46, 48 at the forward edge of the expander 30 (that is, the leftmost side in FIG. 2) there is an open space to permit the user to insert the foot 25 into the expander. Preferably, the sidewalls 46, 48 carry one or more straps 52 with associated hook and loop fastening to secure the sidewalls together with the foot inserted into the expander 30.

The base 42 and sidewalls 46, 48 may be filled with cushioning (shown cross-hatched in FIG. 2), such as foam, to provide a snug, comfortable fit when the expander is worn. The back 44 houses the expandable air bladder 50 to which the pneumatic line 36 is coupled. As described above, the apparatus is controlled by the user to direct pressurized air through the line 36 for controlled expansion of the bladder 50 and consequent stretching of the hamstring muscle.

In a preferred embodiment, the bladder 50 and back 44 are configured so that the portion of the back 44 that is placed in contact with the vertical member 26 remains relatively flat or planar, and the expansion of the bladder 50 is thus primarily directed toward the user's leg 24. Moreover, the bladder 50 is shaped so that in expanding away from the stationary surface the bladder enlarges by a progressively greater amount in the direction toward its outermost (upper) part (note the broken line 30 in FIG. 1), so that the portion of the leg that contacts the back 44 of the expander 30 is supported in a generally straight line.

Figure 3:
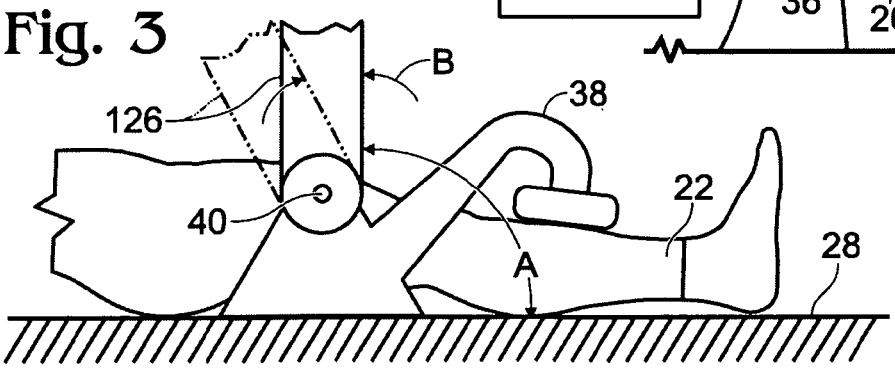
FIG. 3 is a diagram illustrating in side view a portion of an alternative embodiment of the present invention.

FIG. 3 shows an alternative embodiment of the invention whereby the vertical member 126 is integrated with the apparatus. In one approach, the vertical member 126 is in a stationary vertical position and carries the expander 30 (FIGS. 1 and 2). Branching from the vertical member is a brace 38 that is configured to provide contact with the knee of user's rested leg 22, so that leg 22 does not bend upwardly (as it otherwise tends to do) while the other leg 24 is being stretched.

As another approach to the integrated vertical member embodiment (FIG. 3), the vertical member 126 is constructed to rotate about a pivot point 40 to provide the user-controlled increase in angle "B" mentioned above. Any suitable pneumatic, hydraulic or mechanical system would be employed for moving the member 126. This type of movable member could be used without, or in combination with, an expander 30.

Figure 4B:
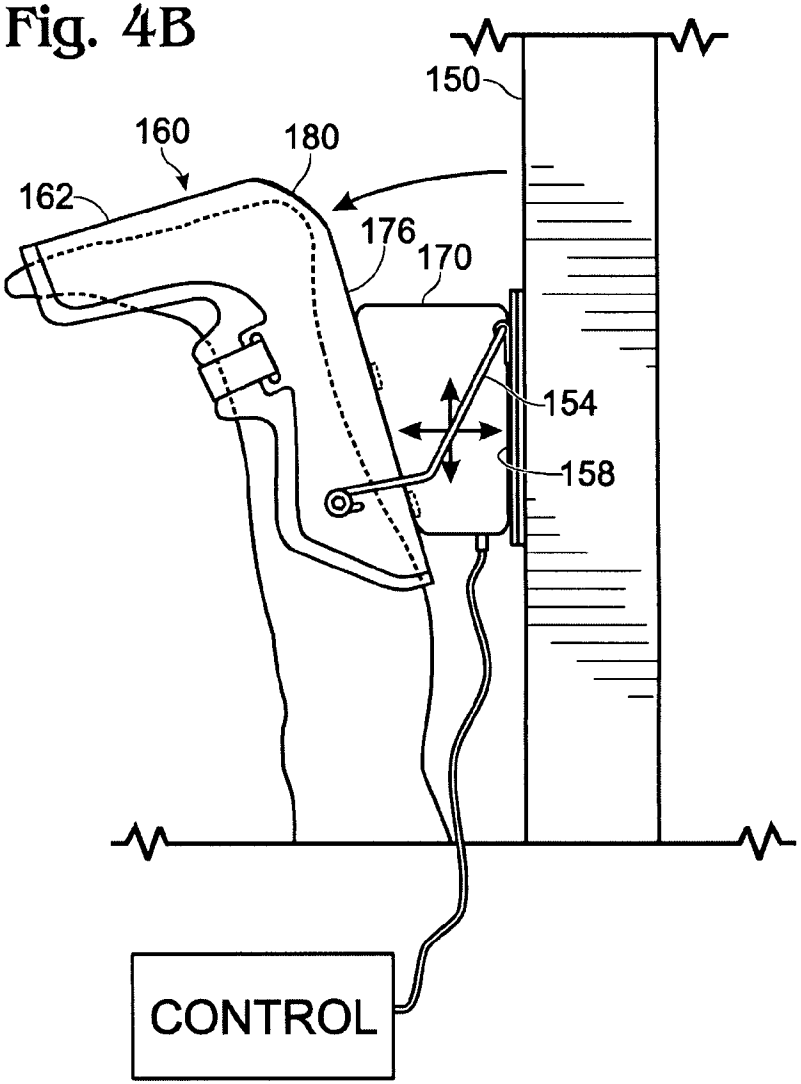
FIGS. 4A and 4B are side views showing another embodiment of the present invention.
Figure 4A:
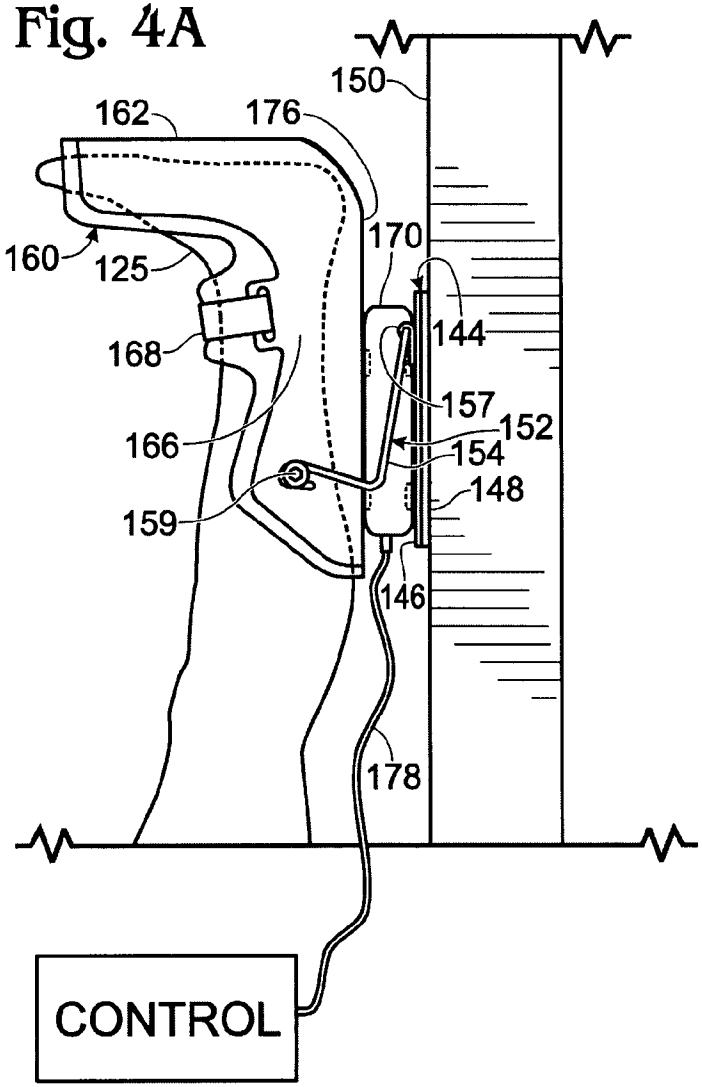

FIGS. 4A and 4B illustrate another preferred embodiment of the present invention. These figures show a side view of this embodiment, which includes a rigid, thin back plate 144. The back plate 144 comprises two layers: a rigid plastic layer 146, such as acrylonitrile butadiene styrene (ABS) to which is bonded an outer layer 148, such as polyester felt. The outer layer 148 bears against a stationary surface 150, such as the surface of a doorjamb, and permits slight vertical sliding movement of the apparatus along the doorjamb without marring that surface.

It is noteworthy here that the back plate 144 may be constructed in a variety of other configurations. For example, the back plate could be mounted to a vertical pole or other structure in a fitness club and adjustable in height to enable use of the apparatus by users of various heights (that is, leg lengths). It will be appreciated that the presently described embodiment, featuring abutting contact with a doorjamb, for example, provides a readily portable and compact apparatus that may be used in various locations around the user's house, hotel room, etc.

Figure 5A:
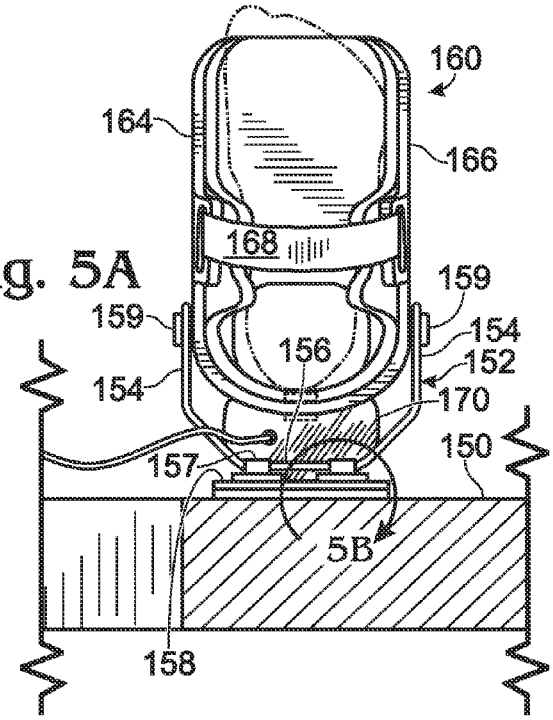
FIG. 5A is a bottom view of the apparatus.

A generally U-shaped linkage 152 (see especially, FIG. 5A) is pivotally mounted to the back plate 144. That linkage includes a pair of arms 154, one arm extending from each of the opposing ends of a connector part 156 of the linkage that extends across the inner surface 158 of the back plate 144. The connector part 156 is secured by spaced-apart sleeves 157 that are fastened to the back plate 144 to make a hinge-like, pivoting connection of the linkage 152 so that the arms 154 are able to swing about the long axis of the connector part 156 toward and away from the back plate 144.

The free end of each arm 154 of the linkage is pivotally attached as at 159 to opposite sides of a boot member 160. The linkage arms 154 are rigid, preferably metal, and serve to stabilize the position of the boot member 160 relative to the back plate 144. The linkage 152 also controls or guides the movement of the boot member as it moves away from and toward the plate.

The boot member 160 may be a molded plastic member, or cut from a flat sheet of plastic (such as polyethylene) and bent and joined to define a base 162 and sidewalls 164, 166 into which fits the foot 125 of a user.

One of the sidewalls 164, 166 carries a strap 168 with associated hook and loop fastening. The free end of the strap is threaded through an aperture in the other sidewall so that the strap may be folded back on itself to secure the sidewalls together and hold the user's foot within the boot member 160.

The boot member 160 may be formed solely of somewhat rigid plastic or, preferably, lined with foam cushioning to enhance the comfort of the boot member.

Figure 5B:
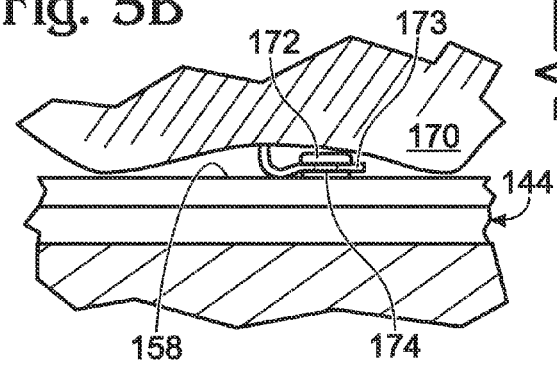
FIG. 5B is an enlarged detail view taken from FIG. 5A.

An expandable bladder 170 is connected to the boot member 160 and to the inner surface 158 of the back plate 144. The bladder 170 is formed or two air-impermeable plastic sheets that are heat-welded together at their peripheral edges. Preferably, the heat-welded edge of the bladder is made wide enough to define a flange 173 (FIG. 5B) to which are riveted the male portions 172 of conventional snap fasteners. The male portions 172 on the bladder flange engage corresponding female portions 174 of snap fasteners that are carried on the both the back 176 of the boot member 160 and on the inner surface 158 of the back plate. In this embodiment, two spaced-apart snap fasteners are thus provided for attaching part of the bladder flange 173 to the boot member, and two fasteners are so used to attach another part of the bladder flange to the back plate 144. It will be appreciated that there may be a variety of alternative ways to attach the bladder between the boot member and back plate. For example, the bladder flange may be stapled or bonded to those respective components.

A pneumatic line 178 couples to the bladder for conducting air to and from the bladder as discussed above in connection with the earlier-described embodiment.

It is noteworthy that the bladder 170 is somewhat trapezoidal in shape (See FIG. 4B) when fully inflated. In this regard, the bladder 170 is connected along a length of the back 176 of boot member, generally adjacent to the user's Achilles tendon, and configured to expand between the boot member 160 and the stationary surface 150 by a varying amount along the length of the boot member in the direction toward the heel 180 of the user. This configuration of the bladder, in conjunction with the pivotal connection with the linkage 152, causes rotation of the boot member as the boot member moves away from the stationary surface so that the stretched leg can be held straight as it rotates about the hip.

Figure 6:
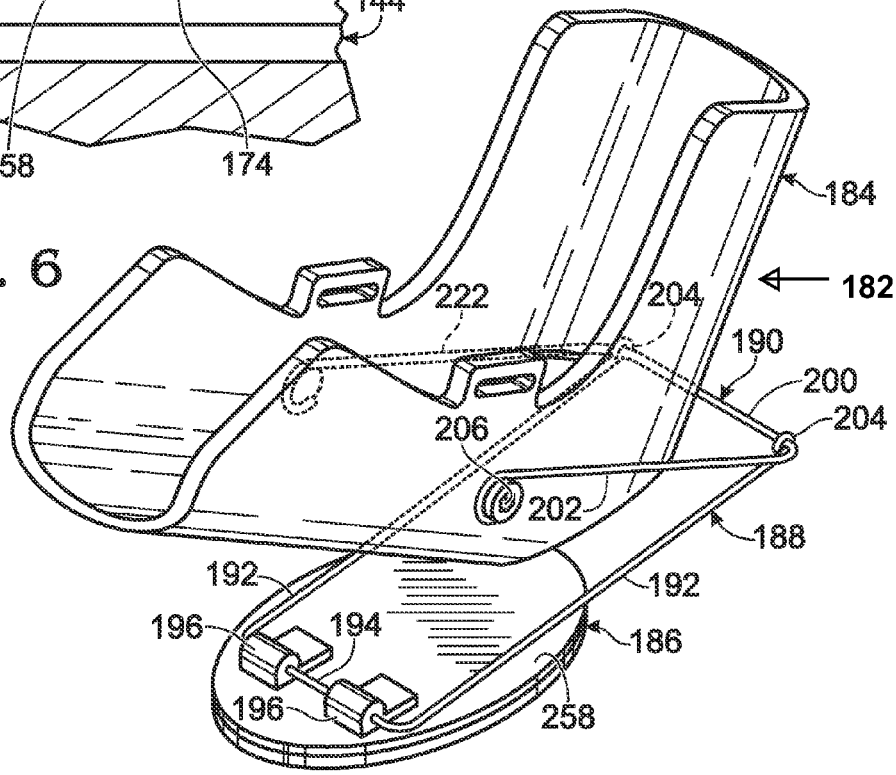
FIG. 6 is a perspective view showing a portion of another alternative embodiment.

FIG. 6 is an isometric view showing a portion of another alternative embodiment that employs a linkage 182 that is essentially a modification of the linkage 152 described above. The bladder and other components have been omitted for illustration purposes. The modified linkage provides the same stability and guidance as mentioned above, but also provides a relatively greater travel distance for the boot member 184 away from the back plate 186, thereby to provide a greater amount of muscular stretching.

The linkage of FIG. 6 includes two pivotally attached parts: a plate-mounted part 188, and a boot-mounted part 190. The plate-mounted part 188 is generally U-shaped and includes a pair of arms 192, one arm extending from each of the opposing ends of a connector part 194 of the linkage that extends across the inner surface 258 of the back plate 186. The connector part 194 is secured to the surface 258 by spaced-apart sleeves 196 that are fastened to the back plate 186 to make a hinge-like, pivoting connection of the plate-mounted linkage part 188 so that the arms 192 are free to swing about the long axis of the connector part 194 toward and away from the back plate 186.

The free end of each arm 192 is pivotally joined to the U-shaped, boot-mounted part 190 of the linkage at the location 204 where the connector part 200 of that linkage joins the arms 202. The free ends of those boot-mounted linkage arms 202 are each pivotally attached as at 206 to opposite sides of the boot member 184. As mentioned, this two-bar linkage 188, although able to collapse so that the boot member 184 can move adjacent to the back plate 186, also permits a relatively large travel distance for the boot member away from the back plate.

While the present invention has been described in terms of preferred embodiments, it will be appreciated by one of ordinary skill in the art that modifications may be made without departing from the teachings and spirit of the foregoing. For example, the expander may be sized to extend nearly the entire length of the user's leg, between the ankle and upper thigh to enhance the comfort or support of the apparatus during its use.

Moreover, it is contemplated that the stationary surface against which the back plate is placed may be horizontal rather than vertical. Also, the air bladder could be replaced with a foam- and/or compression-spring-filled interior that is compressed before use and controlled so that the natural resilience of the foam and/or spring expands the bladder and displaces the boot member from the back plate. A fluid-driven, lightweight telescoping member might also be used alone or with a bladder to expand the distance between the boot member and the back plate.

The invention claimed is:

1. An apparatus for controlling movement of a user's leg relative to a stationary surface for enabling muscular stretching of the leg, comprising:

a boot member configured to receive a single leg of a user and including two opposing sidewalls extending from a back and defining an opening to permit the user to insert the leg between the sidewalls so that the back is adjacent to the Achilles tendon of the user when the user's leg is received in the boot member;

an inflatable bladder connected along a length of the back of the boot member and positionable adjacent to the surface and configured to expand between the back of the boot member and the stationary surface by a varying amount along the length so that expansion of the bladder causes movement of the entire boot member relative to the other leg of the user and away from the stationary surface.

2. The apparatus of claim 1 including a back plate linked to the boot member with the bladder disposed between the back plate and back of the boot member such that the back plate may be placed in contact with the stationary surface so that the entire boot member moves away from the back plate and stationary surface upon expansion of the bladder.

3. The apparatus of claim 2 further comprising linkage pivotally attached to the boot member and to the back plate for guiding the movement of the boot member away from the stationary surface.

4. The apparatus of claim 3 wherein the linkage also includes an intermediate pivot between the boot member and the back plate for defining two separately movable parts of the linkage.

5. The apparatus of claim 3 wherein the linkage and bladder are configured to permit the boot member to move toward the stationary surface upon contraction of the bladder and so that the back of the boot member can be located adjacent to the back plate with the bladder contracted therebetween.

6. The apparatus of claim 1 including a remote control for controlling expansion of the bladder.

7. The apparatus of claim 6 including a control for permitting contraction of the bladder.

8. The apparatus of claim 7 wherein the remote control is manually operated by the user.

9. The apparatus of claim 6 wherein the remote control includes a pump for inflating the bladder.

10. The apparatus of claim 9 wherein the remote control also includes valving that is operable for deflating the bladder.

11. The apparatus of claim 1 wherein the apparatus is configured so that expansion of the bladder causes rotation of the boot member about a location distant from the boot member as the boot member moves away from the stationary surface.

12. The apparatus of claim 1 wherein the boot member includes a strap for securing the user's leg to the boot member.

13. The apparatus of claim 1 wherein the bladder includes a peripheral flange to which are mounted fasteners for connecting the bladder to the boot member and to the back plate.

* * * * *